US005387498A

United States Patent [19]

Ellis

[11] Patent Number: 5,387,498

[45] Date of Patent: Feb. 7, 1995

[54] POSITIVE-ACTING PHOTOTHERMOGRAPHIC MATERIALS COMPRISING A PHOTO-ACID GENERATOR

[75] Inventor: Richard J. Ellis, Great Dunmow, Great Britain

[73] Assignee: Minnesota Mining and Manufacturing Company, St. Paul, Minn.

[21] Appl. No.: 185,293

[22] Filed: Jan. 24, 1994

Related U.S. Application Data

[63] Continuation of Ser. No. 959,298, Oct. 9, 1992, abandoned.

[30] Foreign Application Priority Data

Oct. 14, 1991 [GB] United Kingdom ..... 9121795

[51] Int. Cl.[6] ..... G03C 5/16; G03C 1/00; G03C 3/00

[52] U.S. Cl. ..... 430/353; 430/495; 430/617; 430/618

[58] Field of Search ..... 430/353, 495, 617, 618, 430/619, 620

[56] References Cited

U.S. PATENT DOCUMENTS

| | | | |
|---|---|---|---|
| 3,765,829 | 9/1973 | Ohkubo | 96/114.1 |
| 3,808,006 | 4/1974 | Smith | 430/495 |
| 4,459,350 | 7/1984 | Przezdziecki | 430/353 |
| 4,610,957 | 9/1986 | Kato et al. | 430/617 |
| 4,924,009 | 5/1990 | Neckers | 430/138 |
| 5,229,244 | 7/1993 | Hertler et al. | 430/271 |
| 5,262,295 | 11/1993 | Tanaka et al. | 430/353 |
| 5,312,721 | 5/1994 | Gesing | 430/353 |

FOREIGN PATENT DOCUMENTS

| | | | |
|---|---|---|---|
| 0107093A3 | 2/1984 | European Pat. Off. . | |
| 0359430A3 | 8/1989 | European Pat. Off. . | |
| 0345444 | 12/1989 | European Pat. Off. | 430/495 |
| 0413087A1 | 4/1990 | European Pat. Off. . | |
| 3-154059 | 7/1991 | Japan | 430/495 |
| 1342525 | 3/1974 | United Kingdom . | |
| 1495335 | 12/1977 | United Kingdom . | |
| 2049971A | 12/1980 | United Kingdom . | |
| 2085609A | 4/1982 | United Kingdom . | |

OTHER PUBLICATIONS

Research Disclosure, No. 16408, Dec. 1977, pp. 15–16, by Kohrt.

Research Disclosure, No. 19419, Jun. 1980, pp. 264–268.

Research Disclosure No. 125, Sep. 1974, HAVANT GB pp. 40–41.

*Primary Examiner*—Charles L. Bowers, Jr.

*Assistant Examiner*—J. Pasterczyk

*Attorney, Agent, or Firm*—Gary L. Griswold; Walter N. Kirn; Mark A. Litman

[57] ABSTRACT

Positive-acting photothermographic elements suitable for use in graphic arts and medical imaging comprising a photosensitive medium comprising a reducible silver source, a photo-acid generator, a binder and a reducing system for silver ion comprising a reducing agent for silver ion in which exposure of the element to actinic radiation causes the production of acidic species in the exposed regions which inhibit reduction of the silver source by the reducing system.

15 Claims, 4 Drawing Sheets

POSITIVE-ACTING PHOTOTHERMOGRAPHIC MATERIALS COMPRISING A PHOTO-ACID GENERATOR

This is a continuation of application Ser. No. 07/959,298 filed Oct. 9, 1992, now abandoned.

FIELD OF THE INVENTION

This invention relates to imaging materials and in particular to black & white, positive-acting photothermographic materials.

BACKGROUND TO THE INVENTION

There is a growing need for a range of positive-acting imaging materials able to complement negative-acting Dry Silver materials, particularly for application in graphic arts and medical imaging. For such uses, prospective imaging materials should desirably exhibit the following characteristics:

(i) contact ($10^5$ to $10^3$ erg/cm$^2$) or higher speeds, (ii) dry processing, preferably using standard Dry Silver processing conditions, and (iii) thermally stable for archival storage purposes.

The prior art has long sought to provide suitable positive-acting photothermographic materials, examples of which include those materials disclosed by British Patent Nos. 1156933, 1172425, 1507829, 2022277 and 2195463; European Patent Nos. 223587, 301539, 320020 and 362827; U.S. Pat. Nos. 3589901, 4075017, 4124387, 4587198, 4753862, 4761360, 4772541, 4800149, 4814252 and 4865942, and Japanese Patent Nos. 53-120520, 57-089750, 57-101832, 58-040543, 58-040544, 60-030931, 61-107243, 61-183460, 61-188535, 61-022841, 62-187837, 62-178742, 63-034536 and 63-330064.

Our copending British Patent Application No. 9121789.3 of even date discloses positive-acting photothermographic elements having a photosensitive medium comprising a dispersion of a reducible silver source and a reducing system for silver ion and a photocurable composition. The photocurable composition comprises a free radical curable resin and a photoinitiator having an absorbance to radiation in the wavelength range of 340 to 440nm. In those areas of the element exposed to radiation, the photoinitiator promotes curing of the free radical curable resin, thereby increasing the glass-transition temperature of the resin in those regions, and effectively immobilising or otherwise preventing the reducing system from reacting with the reducible silver source during subsequent thermal processing. Examples of suitable photoinitiators include onium salts, such as iodonium and sulphonium salts, which may be used alone or in combination with a sensitiser, e.g., oxonol dyes, 1,4-dihydropyridines and triarylpyrazolines.

The present invention seeks to provide alternative positive-acting photothermographic materials.

BRIEF DESCRIPTION OF THE INVENTION

According to the present invention there is provided a positive-acting photothermographic element having a photosensitive medium comprising a reducible silver source, a photo-acid generator, a binder and a reducing system for silver ion comprising a reducing agent for silver ion in which exposure of the element to actinic radiation causes the production of acidic species in the exposed regions which inhibit reduction of the silver source by the reducing system.

DESCRIPTION OF PREFERRED EMBODIMENTS

Figure 1A:
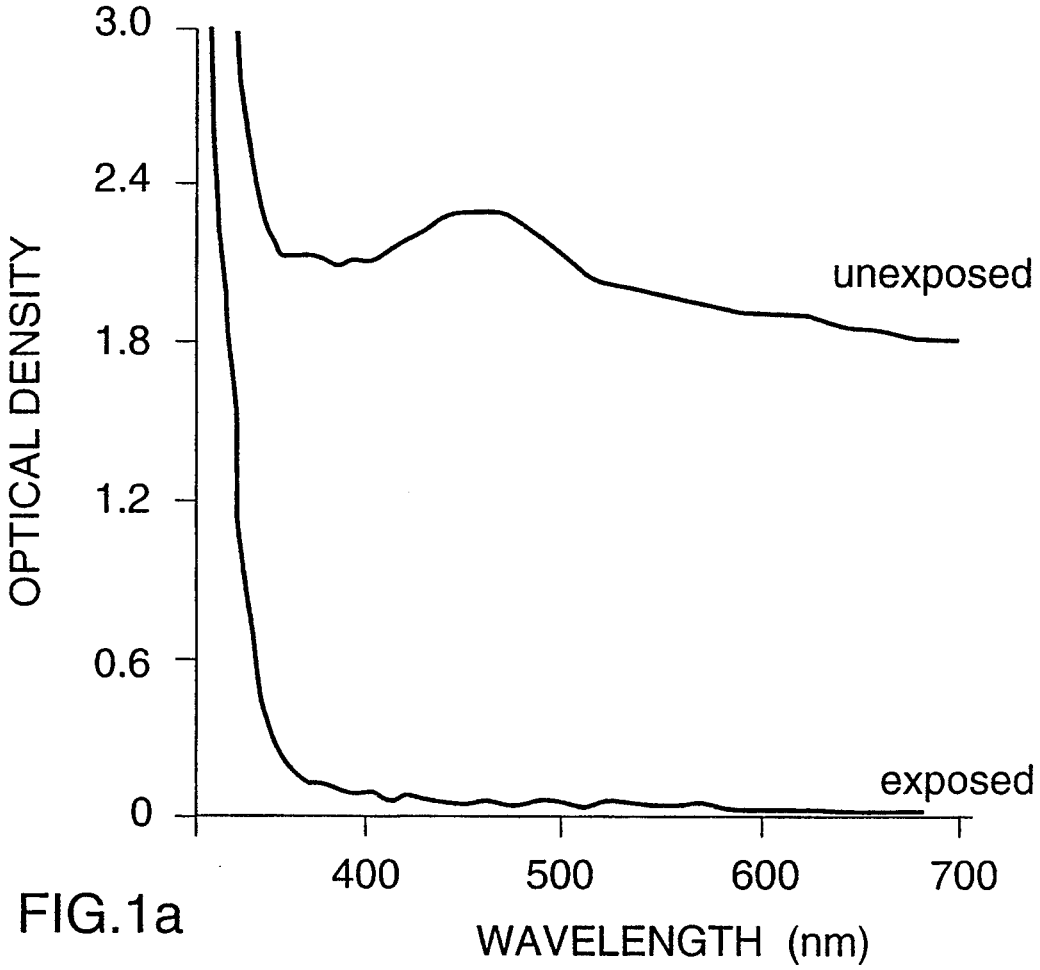
FIG. 1(*a*) and (*b*) graphically show the UV/vis spectrum versus wavelength for two elements.

The photothermographic element of the invention generally comprises a dispersion of a reducible silver source, a reducing system for silver ion and a photo-acid generator, as well as optional additives, such as coating aids and other adjuvants, in one or more binder layers. In those areas of the element exposed to radiation, the acidic species produced by the photo-acid generator inhibit subsequent thermal reduction of the silver source to give well-defined positive images. The reducing system comprises at least a compound capable of reducing silver ion to silver metal. In its simplest form it consists of a reducing agent for silver ion (i.e. a developer), but preferably it also comprises one or more compounds, known in the photothermographic art as toners, which enhance the effect of the developer.

It should be noted that the photothermographic elements of the invention do not require the presence of light-sensitive silver halides; indeed, the absence of such materials is preferred from the point of view of pre- and post-imaging stability. Preferably less than 0.75% by weight of the silver source is in the form of silver halides, more preferably less than 0.5% is in the form of silver halides. Most preferably, the elements are essentially free of silver halides.

The photothermographic elements of the invention are suitable for use in a wide range of imaging fields including contact printing, although they find particular utility in the production of daylight-handleable, dry-processed duplicating films, and are found to have good pre- and post-exposure stability.

The invention also relates to a method of generating a positive image comprising (a) imagewise exposing a photothermographic element of the invention to radiation to produce a latent image and (b) heating the exposed element to develop the latent image.

The photothermographic elements of the invention usually comprise at least two binder layers within which are dispersed the relevant photothermographic chemistry. Normally, the reducible silver source is contained in one layer and the reducing agent for silver ion in a separate layer. When a toner is also present, at least one and more preferably both of the reducing agent and toner are contained in a layer separate from that containing the reducible silver source.

In one embodiment, the photothermographic element comprises a support having on one surface thereof, a first binder layer comprising the reducible silver source and a second binder layer comprising the reducing agent for silver ion and the photo-acid generator. Alternatively, the photo-acid generator may be included in the first binder layer together with the reducible silver source, or in both the first and second binder layers. The latter is preferred, as the presence of the photo-acid generator in the layer containing the reducible silver source is found to enhance the sensitivity of the element.

The photothermographic element may optionally be provided with an inert barrier layer overlying the other layers. Suitable barrier materials include coatings of water-soluble polymers, such as gelatin, poly(vinyl alcohol), poly(vinyl pyrrolidone) etc., or organo-soluble polymers, such as cellulose esters, optionally containing one or more surfactants, and laminated sheets of a transparent material, e.g., polyester, optionally treated with a surfactant or other coating aids.

Generally, each layer of the photothermographic element is coated at a wet thickness of from 25 to 250 μm, with a typical value of about 150 μm, and comprises from 1 to 90%, preferably 5 to 50% by weight of solids in the layer.

The reducible silver source may comprise any material which contains a reducible source of silver ions. Silver salts of organic and hetero-organic acids, particularly long chain fatty carboxylic acids (comprising from 10 to 30, preferably 15 to 25 carbon atoms)-are preferred. Complexes of organic or inorganic silver salts in which the ligand has a gross stability constant for silver ion of between 4.0 and 10.0 are also useful. Examples of suitable silver salts are disclosed in Research Disclosure Nos. 17029 and 29963 and include: salts of organic acids, e.g., gallic acid, oxalic acid, behenic acid, stearic acid, palmitic acid, lauric acid and the like; silver carboxyalkylthiourea salts, e.g., 1(3-carboxypropyl)thiourea, 1-(3-carboxypropyl)-3,3-dimethylthiourea and the like; complexes of silver with the polymeric reaction product of an aldehyde with a hydroxy-substituted aromatic carboxylic acid, e.g., aldehydes, such as formaldehyde, acetaldehyde and butyraldehyde, and hydroxy-substituted acids, such as salicylic acid, benzilic acid, 3,5-dihydroxybenzilic acid and 5,5-thiodisalicylic acid; silver salts or complexes of thiones, e.g., 3-(2-carboxyethyl)-4-hydroxymethyl-4-thiazoline-2-thione and 3-carboxymethyl-4-methyl-4-thiazoline-2-thione; complexes or salts of silver with nitrogen acids selected from imidazole, pyrazole, urazole, 1,2,4-triazole and 1H-tetrazole, 3-amino-5-benzylthio-1,2,4-triazole and benzotriazole; silver salts of saccharin, 5-chlorosalicylaldoxime and the like; and silver salts of mercaptides.

The preferred silver source is silver behenate.

The reducible silver source generally comprises from 5 to 70, preferably from 7 to 45% by weight of its binder layer.

The reducing agent for the silver source may comprise any of the conventional photographic developers known in the art, such as phenidone, hydroquinones and catechol, although hindered phenols are preferred.

Examples of suitable reducing agents are disclosed in U.S. Pat. Nos. 3770448, 3773512 and 3893863 and Research Disclosure Nos. 17029 and 29963 and include: aminohydroxycycloalkenone compounds; esters of amino reductones as developing agent precursors; N-hydroxyurea derivatives; hydrazones of aldehydes and ketones; phosphoramidophenols; phosphoramidoanilines; polyhydroxybenzenes, e.g., hydroquinone, t-butyl-hydroquinone, isopropylhydroquinone, and (2,5-dihydroxyphenyl)methylsulfone; sulfhydroxamic acids; sulfonamidoanilines; 2-tetrazolylthiohydroquinones, e.g., 2-methyl-5-(1-phenyl-5-tetrazolylthio)hydroquinone; tetrahydroquinoxalines, e.g., 1,2,3,4-tetrahydroquinoxaline; amidoximes; azines; a combination of an aliphatic carboxylic acid aryl hydrazide and ascorbic acid; a combination of a polyhydroxybenzene and a hydroxylamine, a reductone and/or a hydrazine, hydroxamic acids; a combination of an azine and a sulfonamidophenol; an α-cyanophenylacetic acid derivative; a combination of a bis-β-naphthol and a 1,3-dihydroxybenzene derivative; 5-pyrazolones; sulfonamidophenol reducing agents; 2-phenylindane-1,3-dione and the like; 1,4-dihydropyridines, such as 2,6-dimethoxy-3,5-dicarbethoxy-1,4-dihydropyridine; bisphenols, e.g., bis(2-hydroxy-3-t-butyl-5-methylphenyl)methane, bis(6-hydroxy-m-toly)mesitol, 2,2-bis(4-hydroxy-3-methylphenyl)propane, 4,4-ethylidenebis(2-t-butyl-6-methylphenol) and 2,2-bis(3,5-dimethyl-4-hydroxyphenyl)propane, UV sensitive ascorbic acid derivatives and 3-pyrazolidones.

The preferred developers are hindered phenols of general formula (I):

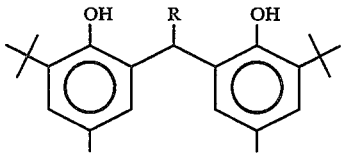

(I)

in which;

R represents hydrogen or an alkyl group, generally comprising up to 5 carbon atoms, e.g., $—C_4H_9$.

The reducing agent is generally present in an amount from 2 to 15% by weight of its binder layer.

The presence of a toner, sometimes referred to as a tone modifier, is not essential to the construction, but is highly preferred. The precise mode of action of toners is not well understood, but it is believed that they catalyse the reaction between the developer and silver ions. They also influence the physical form of the silver metal produced in the reaction and hence the appearance ("tone") of the developed image. Examples of suitable toners are disclosed in Research Disclosure No. 17029 and include: imides, e.g., phthalimide; cyclic imides, pyrazolin-5-ones and a quinazolinone, such as succinimide, 3-phenyl-2-pyrazolin-5-one, 1-phenylurazole, quinazoline and 2,4-thiazolidinedione; naphthalimides, e.g., N-hydroxy-1,8-naphthalimide; cobalt complexes, e.g., cobaltic hexammine trifluoroacetate; mercaptans, e.g., 3-mercapto-1,2,4-triazole; N-(aminomethy) aryl dicarboximides, e.g., N-(dimethylaminomethyl)phthalimide; a combination of blocked pyrazoles, isothiuronium derivatives and certain photobleach agents, e.g., a combination of N,N'-hexamethylene bis(1-carbamoyl-3,5-dimethylpyrazole), 1,8-(3,6-dioxaoctane)-bis(isothiuronium trifluoroacetate) and 2-(tribromomethylsulfonyl) benzothiazole); merocyanine dyes, such as 3-ethyl-5-[(3-ethyl-2-benzothiazolinylidene)-1-methylethyl-idene]-2-thio-2,4-oxazolidinedione; phthalazinone, phthalazinone derivatives or metal salts of these derivatives, such as 4-(1-naphthyl)phthalazinone, 6-chlorophthalazinone, 5,7-dimethoxyphthalazinone and 2,3-dihydro-1,4-phthalazinedione; a combination of phthalazinone and a sulfinic acid derivative, e.g., 6-chlorophthalazinone plus sodium benzene sulfinate or 8-methylphthalazinone plus sodium p-tolylsulfinate; a combination of phthalazinone plus phthalic acid; a combination of phthalic acid and imidazole or benzimidazole; a combination of phthalazine (including an adduct of phthalazine and maleic anhydride) and at least one compound consisting of a phthalic acid, a 2,3-napthalene dicarboxylic acid or an o-phenylene acid derivative and anhydrides thereof, e.g., phthalic acid, 4-methylphthalic acid, 4-nitrophthalic acid and tetrachlorophthalic anhydride; quinazolinediones, benzoxazine or naphthoxazine derivatives, rhodium complexes, e.g., ammonium hexachlororhodate (III), inorganic peroxides and persulfates, e.g., ammonium peroxydisulfate; benzoxazine-2,4-diones, e.g., 1,3-benzoxazine-2,4-dione; pyrimidines and asym-triazines, e.g., 2,4-dihydroxypyrimidine and tetrazapentalene derivatives, e.g., 3,6-dimercapto-1,4-diphenyl-1H,4H-2,3a,5,6a-tetrazapentalene.

The preferred toner is phthalazinone:

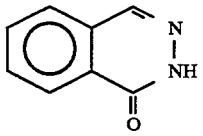

optionally in combination with tetrachlorophthalic acid or its anhydride.

The toner, when present, is generally included in amounts of from 0.2 to 12% by weight of its binder layer.

A vast number of known compounds and mixtures, such as diazonium salts, phosphonium salts, sulphonium salts, e.g., triphenyl sulphonium salts and iodonium salts or halogen compounds, quinone diazide sulfochlorides, trichloromethylpyrones, bis(trichloromethyl)-s-triazines, e.g., 2-(p-methoxystyryl-4,6-bis(trichloromethyl)-s-triazine, and organometal/organohalogen combinations, may be used as radiation-sensitive constituents forming or splitting-off acids during irradiation of the element. Compounds containing no basic substituents are preferred.

Suitable diazonium salts are compounds having an absorption range between 300 and 500 nm, which are known to be suitable for diazotype purposes.

As a rule, the above mentioned diazonium, phosphonium, sulfonium and iodonium compounds are used in the form of salts soluble in organic solvents, normally as the separation products of complex acids, such as tetrafluoroboric acid, hexafluorophosphoric acid hexafluoroantimonic acid and hexafluoroarsenic acid.

Alternatively derivatives of positive working quinone diazides may be used. From this group of compounds, naphthoquinone-1,2-diazide-4-sulfochloride is preferred, because, during its exposure, three acid functions are formed which give rise to a relatively high degree of intensification.

In principle, all organic halogen compounds known as free radical forming photoinitiators, for example, those containing more than one halogen atom attached to a carbon atom or an aromatic ring, may be used as halogen containing radiation-sensitive compounds capable of forming a hydrohalic acid. Examples of such compounds are disclosed in U.S. Pat. Nos. 3515552, 3536489 and 3779778 and in German Offenlegungsschrift No. 2243621.

Furthermore, certain substituted trichloromethypyrones, such as those described in German Offenlegungsschrift No. 2610842 may also be used, as well as 2-aryl-4,6-bis-trichloromethyl-s-triazines.

Examples of suitable photo-acid generators include:

4-(di-n-propyl-amino)-benzene-diazoniumtetrafluoroborate, 4-p-tolylmercapto-2,5-diethoxybenzene-diazonium hexafluorophosphate 4-p-tolymercapto-2,5-diethoxybenzene-diazonium tetrafluoroborate;

diphenylamine-4-diazonium sulfate, 4-methyl-6-trichloromethyl-2-pyrone, 4-(3,4,5-trimethoxystyryl)-6-trichloromethyl-2-pyrone, 4-(4-methoxystyryl)-6-(3,3,3-trichloro-propenyl)-2-pyrone, 2-trichloromethylbenzimidazole, 2-tribromomethylquinoline, 2,4-dimethyl-tribromoacetylbenzene, 3-nitro-1-tribromoacetylbenzene, 4-dibromoacetylbenzoic acid, 1,4-bis-dibromomethylbenzene, tris-dibromomethyl-s-triazine, 2-(6-methoxy-naphth-2-yl)-4,6-bis-trichloromethyl-s-triazine, 2-(naphth-l-yl)-4,6-bis-trichloromethyl-s-triazine, 2-(4-ethoxyethyl-naphth-1-yl)-4,6-bis-trichloromethyl-s-triazine, 2-(benzopyran-3-yl)-4,6-bis-trichloromethyl-striazine, 2-(4-methoxy-anthracene-1-yl) -4,6-bis-trichloromethyl-s-triazine, and 2-(phenanthr-9-yl)-4,6-bis-trichloromethyl-s-triazine.

The quantity of the photo-acid generator may vary widely depending on its chemical nature and the exact composition of the photosensitive medium. The photo-acid generator must, however, be present in an effective amount to inhibit thermal development in the exposed region(s) of the element. Generally, the photo-acid generator is present in an amount of from 0.5 to 30% preferably 1 to 20%, more preferably 2 to 15% by weight, based on the total weight of the solids.

The preferred photo-acid generators for use in the present invention are iodonium and sulphonium salts.

The iodonium salt may comprise any of the photosensitive iodonium salts known to the art, for example, those iodonium salts disclosed in U.S. Pat. Nos. 3729313, 3741769, 3808006, 4026705, 4228232, 4250053, 4701402, and 4769459. Either a single iodonium salt or a combination of two or more iodonium salts may be used.

Iodonium salts are compounds having a positively charged iodine atom bearing two covalently bonded carbon atoms and any anion. Aliphatic iodonium salts are not normally thermally stable at temperatures above O° C. However, stabilised alkyl phenyl iodonium salts, such as those disclosed in *Chemical Letters* (1982) pp. 65–6, are stable at ambient temperatures and may be used in the invention. The preferred compound are diaryl, arylheteroaryl and diheteroaryl iodonium salts in which the carbon-to-iodine bonds are formed by the aryl or heteroaryl groups.

Sulphonium salts are compounds having a positively charged sulphur atom bearing three (or more) covalently bonded carbon atoms and an anion. The preferred sulphonium salts are aryl, aryl-heteroaryl and heteroryl sulphonium salts in which the carbon-to-sulphur bonds are formed by the aryl or heteroaryl groups.

Suitable photosensitive iodonium and sulphonium salts are represented by general formulae (II) and (III) below:

$I^+-(A)_2X^-$ (II)

$S^+-(A)_3X$ (III)

in which;

each A independently represents an aromatic or heteroaromatic group which may be linked together to include the iodine or sulphur atom within a ring structure, and $X^-$ is an anion such that HX is an acid of pKa not greater than 3.

The aromatic group(s) represented by A generally comprises from 4 to 20, preferably 4 to 14 and more preferably 4 to 10 constituent atoms, and may be selected from aromatic carbocyclic rings, e.g., phenyl or naphthyl, and aromatic heterocyclic rings including thienyl, furanyl and pyrazolyl, and may optionally possess one or more substituents selected from alkyl groups comprising up to 5 carbon atoms, e.g., methyl, alkoxy groups comprising up to 5 carbon atoms, e.g., methoxy, halogen atoms, such as chlorine, bromine, iodine and fluorine, carboxy groups comprising up to 5 carbon atoms, cyano and nitro groups, or any combination thereof. Condensed aromatic-heteroaromatic groups, e.g., 3-indolinyl, may also be present.

Examples of suitable iodonium salts include:

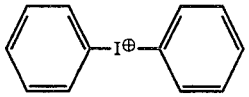
$CF_3CO_2^\ominus$

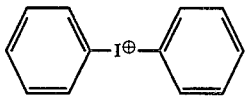
$Br^\ominus$

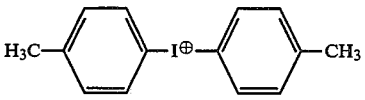
$PF_6^\ominus$

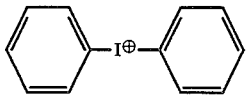
$SbF_6^\ominus$

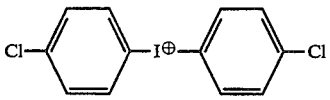
$PF_6^\ominus$

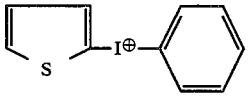
$CF_3CO_2^\ominus$

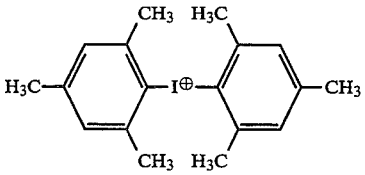
$PF6^\ominus$

-continued

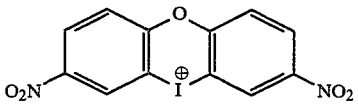
$PF_6^\ominus$

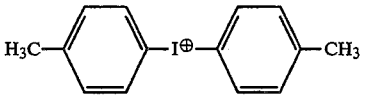
$Cl^\ominus$

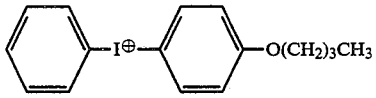
$PF_6^\ominus$

Most of the iodonium salts are known, they may be readily prepared and some are commercially available. The synthesis of suitable iodonium salts is disclosed in F. M. Beringer et al., Journal of the American Chemical Society, 80, 4279 (1958).

The preferred photo-acid generator is a sulphonium salt having a nucleus of the formula:

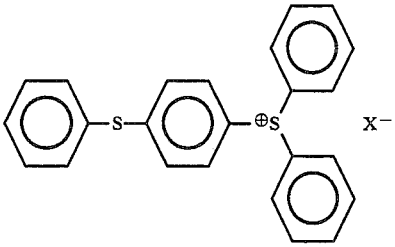
$X^-$ in which;

$X^-$ is as defined previously.

Many anions are useful as the counter-ion in the onium salt, provided the acid from which the anion is derived has a pKa of less than 3, preferably less than 1. Suitable inorganic anions include halide anions, $HSO_4^-$, and halogen-containing complex anions, e.g., tetrafluoroborate, hexafluorophosphate, hexafluoroarsenate and hexafluoroantimonate. Suitable organic anions include those of the formulae $R^1CO_2^-$ and $R^1SO_3^-$ where $R^1$ represents an alkyl or aryl group, either of which may be substituted, for example: $CF_3CO_2^-$, $CCl_3CO_2^-$, $CH_3SO_3^-$, $CF_3SO_3^-$, $CH_3C_6H_4SO_3^-$ The photothermographic chemistry of the element is typically applied to the support in a binder. A wide range of binders may be employed in the various layers of the photothermographic element. Suitable binders are transparent or translucent, are generally colourless and include natural polymers, synthetic resins, polymers and copolymers and other film forming media such as: gelatin, gum arabic, poly(vinyl alcohol), hydroxyethyl cellulose, cellulose acetate, cellulose acetate butyrate, poly(vinyl pyrrolidone), casein, starch, poly(vinyl chloride), copoly(styrene-maleic anhydride), copoly(styrene acrylonitrile), copoly(styrene-butadiene), polyvinyl acetals, e.g., poly(vinyl formal) and poly(vinyl butyral), polyesters, polyurethanes, phenoxy resins, poly(vinylidene chloride), polyepoxides, polycarbonates, poly(vinyl acetate), cellulose esters and polyamides. The binders may be coated from aqueous or organic solvents or an emulsion.

The binders may optionally comprise cross-linking components, as described in our copending British Patent Application No. 9121789.3 of even date. Suitable cross-linkers include polyfunctional acrylates, such as hydantoin hexaacrylate, trimethylolpropane trimethacrylate and the like. In situations where photolysis of the photo-acid generator also produces free radicals, photocuring may occur in the light-struck areas, which in turn hinders the diffusion of the developer or toner towards the silver salt, and may provide an improved image differential. However, this is not an essential feature of the invention. Examples of acid generators which also produce radicals on photolysis include iodonium salts, sulphonium salts and trichloromethyltriazines.

The photothermographic elements of the invention are prepared by simply coating a suitable support or substrate with the one or more binder layers containing the photothermographic chemistry and, optionally, the barrier layer. Each layer is generally coated from a suitable solvent using techniques known in the art.

In one highly preferred embodiment, the photothermographic element comprises a support having coated on one surface thereof a first binder layer comprising the silver salt of an organic or a hetero-organic acid, e.g., silver behenate, and the photo-acid generator, preferably a sulphonium salt, and a second binder layer comprising a developer, preferably a hindered phenol. A toner is preferably included in the second binder layer. In alternative embodiments, the order of coating the first and second binder layers may be reversed and the photo-acid generator may be incorporated into the second binder layer, either instead of or in addition to its inclusion in the first.

Exemplary support include materials such as paper, polyethylene-coated paper, polypropylene-coated paper, parchment, cloth and the like; sheets and foils of such metals as aluminium, copper, magnesium and zinc; glass and glass coated with such metals as chromium, chromium alloys, steel, silver, gold and platinum; synthetic polymeric materials such as poly(alkyl methacrylates), e.g., poly(methyl methacrylate), polyesters, e.g., poly(ethylene terephthalate), poly(vinylacetals), polyamides, e.g., nylon, cellulose esters, e.g., cellulose nitrate, cellulose acetate, cellulose acetate propionate and cellulose acetate butyrate, and the like.

A variety of conventional additives such as surfactants, anti-oxidants, stabilisers, plasticisers, ultraviolet absorbers, coating aids etc., may be used in the preparation of the photographic elements of the invention.

It is not essential for the photothermographic elements of the invention to comprise a separate support since each binder layer, together with the photothermographic chemistry may be cast to form a self-supporting film.

The supports can be sub-coated with known subbing materials such as copolymers and terpolymers of vinylidene chloride with acrylic monomers (such as acrylonitrile and methyl acrylate) and unsaturated dicarboxylic acids (such as itaconic acid or acrylic acid); carboxymethyl cellulose, polyacrylamide; and similar polymeric materials.

The support can also carry a filter or antihalation layer, such as one comprising a polymer layer with a dye therein which absorbs the exposing radiation after it passes through the radiation-sensitive layer. This eliminates unwanted reflection from the support.

The photosensitive media may also contain a sensitiser in order to increase the sensitivity of the system towards radiation of a wavelength longer than that of the intrinsic U.V./blue sensitivity. By suitable selection of the sensitiser a photothermographic element may be prepared which is sensitive to radiation of a selected wavelength band within the general range 300 to 1000nm, the particular wavelength and the width of the band depending upon the absorption characteristics of the sensitiser.

A wide variety of sensitisers are known in the art, but best results are obtained when the sensitiser is free from strongly basic groups that may scavenge the photogenerated acid. Depending on the intended use, it may also be desirable for the sensitiser and/or photo-acid generator to bleach during the exposure/development cycle. For example, if the final image is to be used as a contacting mask in a subsequent imaging process (e.g., of a printing plate), it is vital that the non-image areas are transparent to near-UV and visible light, e.g., in the range 350 to 450 nm, and especially at wavelengths >380nm.

Examples of bleachable sensitisers include: xanthene dye complexes, as disclosed, e.g., in U.S. Pat. No. 4924009, in which a xanthene dye, such as rose bengal, eosin, erythrosin, a fluorescein dye or an ester thereof, is complexed with the photo-acid generator; bleachable 3-substituted coumarin compounds, e.g., as disclosed in U.S. Pat. No 4147552, such as 7-diethylamino-5', 7'-dimethoxy-3,3'-carbonylbiscoumarin, 3,3'-carbonylbis-5,7-dimethoxycoumarin, 7-diethylamino-3,3'-carbonylbiscoumarin and 7-diethylamino-7'-methoxy-3,3'-carbonylbiscoumarin; dialkoxyanthracenes, e.g., 9,10-diethoxyanthracene;

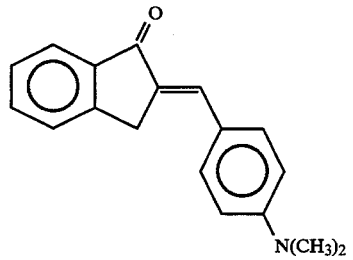

1,4-dihydropyridine sensitisers such as those disclosed at the XIIIth Symposium on Photochemistry, e.g., 3,5-bis(methoxycarbonyl)-2,6-dimethyl-4-phenyl-1,4-dihydropyridine; and 1,3,5-triarylpyrazolines of the formula:

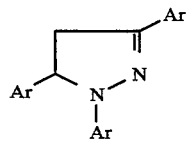

in which;

Ar represents an aryl group.

In use, the photothermographic elements of the invention are imagewise exposed to radiation of an appropriate wavelength to photolyse the photo-acid generator, thereby creating a latent image. Following exposure, the element is dry processed by heating at temperatures of from 90° to 150° C. for 5 to 60 seconds, preferably 125° to 130° C. for 5 to 15 seconds, using techniques known in the art for the processing of negative-acting Dry Silver materials, to develop a positive image. After exposure and heating to achieve the black/-white image a further exposure allows for the image to be fixed for duplication purposes.

The invention will now be described with reference to the following Examples. A glossary of common abbreviations etc., is present below for ease of comprehension.

| Resins/Binders | | Glossary |
|---|---|---|
| TMPTA | = | trimethylolpropane trimethacrylate, commercially available from Ancomer Chemicals Ltd., under the trade designation ATM11. |
| HHA | = | hydantoin hexaacrylate, disclosed in U.S. Pat. No. 4249011 and having the formula: |

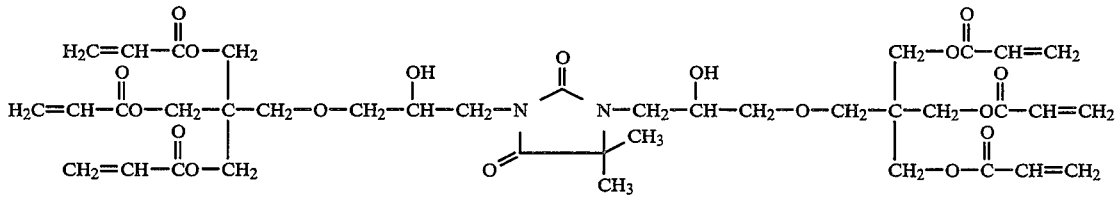

| | | |
|---|---|---|
| Cellulose Acetate Solution | = | a solution of cellulose acetate (8.3 wt. %) in acetone 29.2 wt. %) and methyl ethyl ketone (62.5 wt. %) |
| CAB 381-20 | = | Cellulose acetate butyrate, commercially available from Kodak Ltd. |
| **Sensitiser** | | |
| Oxonol Dye A | = | |

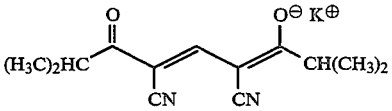

| | | |
|---|---|---|
| TPP | = | 1,3,5-triphenylpyrazoline |

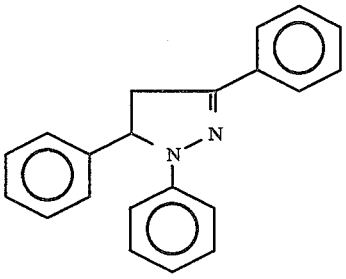

| | | |
|---|---|---|
| DH | = | 3,5-bis(methoxycarbonyl)-2,6-dimethyl-4-phenyl-1,4-dihydropyridine |

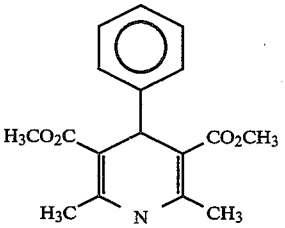

| | | |
|---|---|---|
| DEA | = | 9,10-diethoxyanthracene |
| **Photo-acid generators** | | |
| Iodonium Salt A | = | |

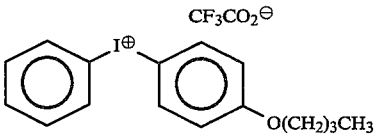

| | | |
|---|---|---|
| Iodonium Salt B | = | |

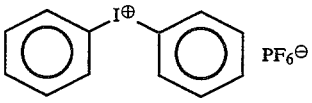

-continued

Sulphonium Salt A =

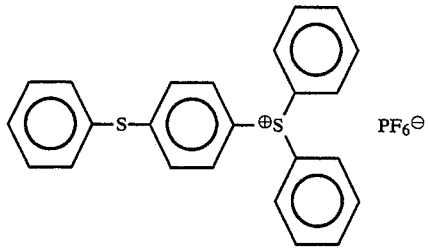

commercially available from Minnesota Mining and Manufacturing Co. under the trade designation FX 512

Triazine A =

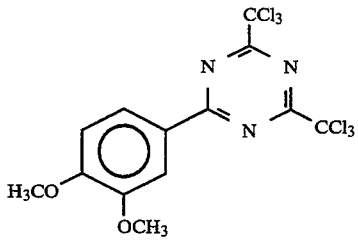

Reducible silver Source

Silver Behenate Full soap: 12.3% by weight silver behenate; 65.3% by weight methyl ethyl ketone; 21.8% by weight toluene and 0.5% by weight BUTVAR B-76 (poly(vinyl butyral)).

Silver Soap Stock Solution: Silver Behenate Full Soap (40 g); CAB-381 (4 g); TMPTA (1 g) and methyl ethyl ketone (17 g).

Reducing Agent
Developer A =

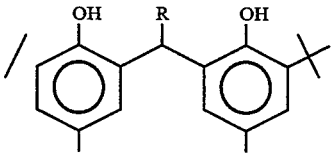

Toner
Toner A =

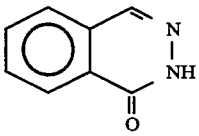

TCPA = tetrachlorophthallic anhydride

"FX512" (3M Co) , "CAB 381-20" (Kodak Ltd), "ATM 11" (Ancomer Chemicals Ltd.) "NU-ARC" and "BUTVAR B-76" are all trade names/designations.

Example 1

The following photothermographic elements were prepared in accordance with the invention. Each element generally comprises a bottomcoat containing the reducible silver source (silver behenate) and a topcoat containing the developer.

| | | |
|---|---|---|
| Photothermographic Element 1 | | |
| Bottomcoat: | Silver Behenate = (Full Soap) | 20 g |
| | HHA = | 2 g |
| | CAB 381-20 = | 2 g |

-continued

| | | |
|---|---|---|
| | Iodonium Salt A = | 0.16 g |
| | TPP = | 0.007 g |
| | Methyl ethyl ketone (MEK) = | 8 g |
| Topcoat: | Cellulose Acetate solution = | 15 g |
| | Developer A = | 0.4 g |
| | Toner A = | 0.04 g |
| | Sulphonium Salt A = | 0.43 g |
| Photothermographic Element 2 | | |
| Bottomcoat: | Silver Behenate = (Full Soap) | 30 g |
| | CAB 381-20 = | 1.5 g |
| | TMPTA = | 4.5 g |
| | TPP = | 0.005 g |
| | Oxonol Dye A = | 0.0045 g |
| | MEK = | 3 g |
| | Iodonium Salt A = | 0.2 g |
| Topcoat: | Cellulose Acetate solution = | 10 g |
| | Developer A = | 0.3 g |
| | Toner A = | 0.03 g |
| | Sulphonium Salt A = | 0.40 g |
| Photothermographic Element 3 | | |
| Bottomcoat: | Silver Behenate = (Full Soap) | 20 g |
| | TMPTA = | 3 g |
| | CAB 381-20 = | 1 g |
| | Iodonium Salt A = | 0.15 g |
| | TPP = | 0.01 g |
| | MEK = | 4 g |
| Topcoat: | Cellulose Acetate solution = | 15 g |
| | Developer = | 0.45 g |
| | Toner = | 0.045 g |
| | Sulphonium Salt A = | 0.53 g |

Elements 4 to 6:

prepared as per Photothermographic Elements 1 to 3 but omitting the photo-acid generator (Sulphonium Salt A) from the topcoat.

| | | |
|---|---|---|
| Photothermographic Element 7 | | |
| Bottomcoat: | Silver Behenate = (Full Soap) | 10 g |
| | BUTVAR B-76 = | 1 g |
| Topcoat: | Cellulose Acetate solution = | 10 g |
| | Developer A = | 0.3 g |
| | Toner A = | 0.03 g |
| | Sulphonium Salt A = | 0.40 g |
| Photothermographic Element 8 | | |
| Bottomcoat: | Silver Behenate = (Full Soap) | 10 g |
| | CAB 381-20 = | 0.5 g |
| | TMPTA = | 1.5 g |
| Topcoat: | Cellulose Acetate solution = | 10 g |
| | Developer A = | 0.3 g |
| | Toner A = | 0.03 g |
| | Sulphonium Salt A = | 0.40 g |
| Photothermographic Element 9 | | |

-continued

| | | |
|---|---|---|
| Bottomcoat: | Silver Soap Stock Solution = | 8 g |
| | Sulphonium Salt A = | 0.16 g |
| Topcoat: | Cellulose Acetate solution = | 10 g |
| | Developer A = | 0.15 g |
| | Toner A = | 0.03 g |
| | sulphonium Salt A = | 0.2 g |
| Photothermographic Element 10 | | |
| Bottomcoat: | Silver Soap Stock Solution = | 20 g |
| | Sulphonium Salt A = | 0.4 g |
| | DH = | 0.016 g |
| Topcoat: | Cellulose Acetate solution = | 10 g |
| | Developer A = | 0.15 g |
| | Toner A = | 0.03 g |
| | sulphonium Salt A = | 0.2 g |
| Photothermograhic Element 11 | | |
| Bottomcoat: | Silver Soap Stock Solution = | 20 g |
| | Sulphonium Salt A = | 0.42 g |
| | TPP = | 0.0047 g |
| Topcoat: | Cellulose Acetate solution = | 10 g |
| | Developer A = | 0.15 g |
| | Toner A = | 0.03 g |
| | sulphonium Salt A = | 0.2 g |
| Photothermographic Element 12 | | |
| Bottomcoat: | Silver Behenate = (Full Soap) | 20 g |
| | CAB 381-20 = | 2 g |
| | TMPTA = | 1 g |
| | Sulphonium Salt A = | 0.5 g |
| | TPP = | 0.006 g |
| | MEK = | 8 g |
| Topcoat: | Cellulose Acetate solution = | 10 g |
| | Developer A = | 0.15 g |
| | Toner A = | 0.02 g |
| Photothermographic Element 13 | | |
| Bottomcoat: | Silver Behenate = (Full Soap) | 20 g |
| | CAB 381-20 = | 2 g |
| | TMPTA = | 1 g |
| | Sulphonium Salt A = | 0.5 g |
| | TPP = | 0.006 g |
| | MEK = | 8 g |
| Topcoat: | Cellulose Acetate solution = | 10 g |
| | Developer A = | 0.15 g |
| | Toner A = | 0.04 g |
| Photothermographic Element 14 | | |
| Bottomcoat: | Silver Soap Stock Solution = | 20 g |
| | Sulphonium Salt A = | 0.42 g |
| | TPP = | 0.0047 g |
| Topcoat: | Cellulose Acetate solution = | 15 g |
| | Developer A = | 0.45 g |
| | Toner A = | 0.045 g |
| | sulphonium Salt A = | 0.45 g |
| Photothermographic Element 15 | | |
| Bottomcoat: | Silver Soap Stock Solution = | 20 g |
| | Sulphonium Salt A = | 0.42 g |
| | TPP = | 0.0047 g |
| Topcoat: | Cellulose Acetate solution = | 15 g |
| | Developer A = | 0.225 g |
| | Toner A = | 0.045 g |
| | sulphonium Salt A = | 0.45 g |

All coatings were applied using a knife edge coater to an unsubbed polyester support (100 μm) at 150 μm wet thickness unless otherwise stated.

All UV exposures were performed using a 6kW NU-ARC UV lamp and the optical density measurements using a DT 1405 transmission densitometer. D LogE curves were plotted using the results from step-wedge exposures.

Example 2

Individual samples of Photothermographic Elements 1 to 6 were each exposed to 50 units of UV radiation and thermally processed for 10 seconds at various temperatures. The optical densities of the exposed (Dmin) and unexposed (Dmax) areas are tabulated in Tables 1 to 3 below.

TABLE 1

| Thermal Processing Temperature (°C.) | Element 1 | | Element 4 | |
|---|---|---|---|---|
| | Dmin | Dmax | Dmin | Dmax |
| 110 | 0.04 | 0.04 | 0.04 | 0.04 |
| 115 | 0.04 | 0.05 | 0.04 | 0.05 |
| 120 | 0.04 | 0.11 | 0.05 | 0.10 |
| 125 | 0.04 | 0.66 | 0.12 | 0.74 |
| 130 | 0.09 | 1.95 | 0.45 | 0.84 |
| 135 | 0.39 | 3.64 | 1.52 | 3.22 |

TABLE 2

| Thermal Processing Temperature (°C.) | Element 2 | | Element 5 | |
|---|---|---|---|---|
| | Dmin | Dmax | Dmin | Dmax |
| 105 | 0.04 | 0.06 | 0.04 | 0.08 |
| 110 | 0.04 | 0.09 | 0.05 | 0.12 |
| 115 | 0.04 | 0.45 | 0.08 | 0.43 |
| 120 | 0.04 | 0.91 | 0.23 | 1.21 |
| 125 | 0.10 | 1.94 | 0.87 | 2.12 |
| 130 | 0.37 | 2.76 | 1.71 | 2.84 |

TABLE 3

| Thermal Processing Temperature (°C.) | Element 3 | | Element 6 | |
|---|---|---|---|---|
| | Dmin | Dmax | Dmin | Dmax |
| 105 | 0.03 | 0.06 | 0.03 | 0.06 |
| 110 | 0.04 | 0.08 | 0.04 | 0.10 |
| 115 | 0.04 | 0.21 | 0.04 | 0.28 |
| 120 | 0.04 | 0.99 | 0.06 | 0.88 |
| 125 | 0.06 | 1.82 | 0.26 | 2.25 |
| 130 | 0.12 | 2.68 | 0.97 | 2.98 |

In Elements 4 to 6, silver behenate was present in a photocurable bottom layer in which the photoinitiator (an iodonium salt) was also an acid generator, and developer was present in the top layer. Elements 1 to 3 were identical except for additional acid generator (sulphonium salt) in the top layer. As can be seen from Tables 1 to 3, both sets of coatings gave useful images but those containing the extra photo-acid generator (Elements 1 to 3) showed lower Dmin and higher Dmax.

All the images produced were positive and neutral in colour.

Figure 1B:
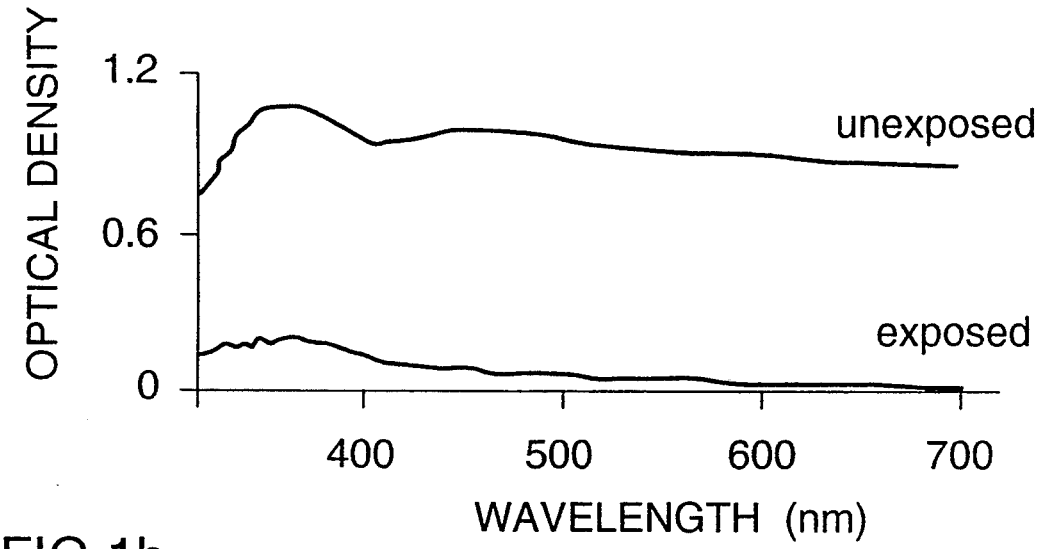

The UV/vis spectra of samples of Elements 3 and 6 processed at 120° and 125° C. respectively were measured (see FIGS. 1*a* and 1*b*) and clearly show a loss of absorption across the region 360 to 700 nm.

Example 3

Individual samples of Photothermographic Elements and 8 in which the only photo-active component, was the photo-acid generator, i.e., no photocurable components, were each exposed to 50 units of UV radiation and thermally processed. The optical densities of the exposed (Dmin) and unexposed (Dmax) areas are tabulated in Table 4 below.

TABLE 4

| Thermal Processing Temperature (°C.) | Element 7 | | Element 8 | |
|---|---|---|---|---|
| | Dmin | Dmax | Dmin | Dmax |
| 105 | 0.04 | 0.04 | 0.04 | 0.05 |
| 110 | 0.05 | 0.06 | 0.04 | 0.07 |
| 115 | 0.05 | 0.09 | 0.04 | 0.20 |
| 120 | 0.05 | 0.21 | 0.04 | 1.04 |
| 125 | 0.05 | 0.70 | 0.05 | 2.35 |
| 127 | 0.06 | 2.57 | — | — |
| 130 | 0.08 | 3.59 | 0.06 | 3.48 |

TABLE 4-continued

| Thermal Processing Temperature (°C.) | Element 7 | | Element 8 | |
|---|---|---|---|---|
| | Dmin | Dmax | Dmin | Dmax |
| 135 | — | — | 0.12 | 3.74 |

Figure 2:
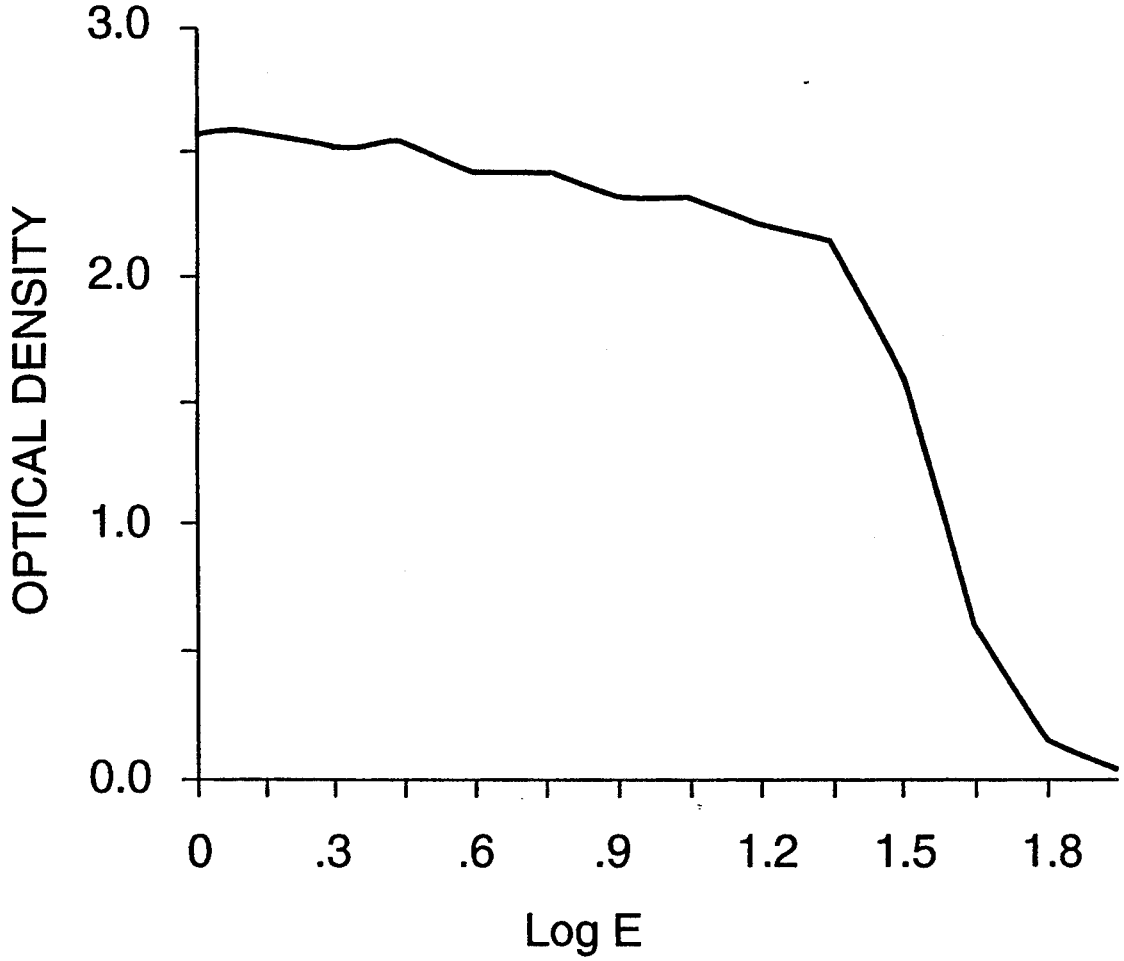
FIG. 2 graphically shows optical density versus exposure for element 8.

All the images produced were positive and neutral in colour. The D LogE curves for both elements are similar (see Table 5 below) and show that both constructions have a high gamma with little optical changes after step level 6. The D LogE curve for Element is shown in FIG. 2.

TABLE 5

| Step Level | | D LogE Results (Optical Density) | |
|---|---|---|---|
| | | Element 7* | Element 8* |
| Dmin | (0) | 0.05 | 0.05 |
| | 1 | 0.14 | 0.15 |
| | 2 | 0.44 | 0.61 |
| | 3 | 1.14 | 1.60 |
| | 4 | 1.71 | 2.17 |
| | 5 | 2.06 | 2.22 |
| | 6 | 2.04 | 2.34 |
| | 7 | 1.99 | 2.34 |
| | 8 | 2.39 | 2.42 |
| | 9 | 2.33 | 2.42 |
| | 10 | 2.15 | 2.54 |
| | 11 | 2.12 | 2.53 |
| | 12 | 2.10 | 2.58 |
| | 13 | — | 2.57 |

*UV = 50 units
Thermal Processing Temperature = 127° C./10 seconds

Example 4

This Example demonstrates the thermal ageing properties of Element 7. Individual strips were imaged using a continuous-tone wedge, thermally processed and then stored at 50° C. The change in density of each step level was then measured. The results are tabulated in Table 6 below.

TABLE 6

| Step Level | | Element 7* | |
|---|---|---|---|
| | | 0 | 6 days |
| Dmin | (0) | 0.06 | 0.07 |
| | 1 | 0.08 | 0.10 |
| | 2 | 0.13 | 0.15 |
| | 3 | 0.31 | 0.36 |
| | 4 | 0.75 | 0.82 |
| | 5 | 0.94 | 1.14 |
| | 6 | 1.11 | 1.40 |
| | 7 | 1.27 | 1.59 |
| | 8 | 1.61 | 2.07 |
| | 9 | 1.58 | 1.86 |
| | 10 | 1.63 | 2.11 |
| | 11 | 1.53 | 1.84 |

*UV = 50 units
Thermal Processing Temperature = 127° C./10 seconds

These results show that Element 7 is almost unchanged after thermal ageing for 6 days at 50° C. and indicates the possibility that images could be prepared which are suitable for long-term archival storage.

Example 5

This Example demonstrates the effect of using a sensitiser in conjunction with the photo-acid generator to increase the sensitivity of the system. The sensitisers tested were a 1,4-dihydropyridine derivative (DH) and a 1,3,5-triarylpyrazoline (TPP).

Figure 3:
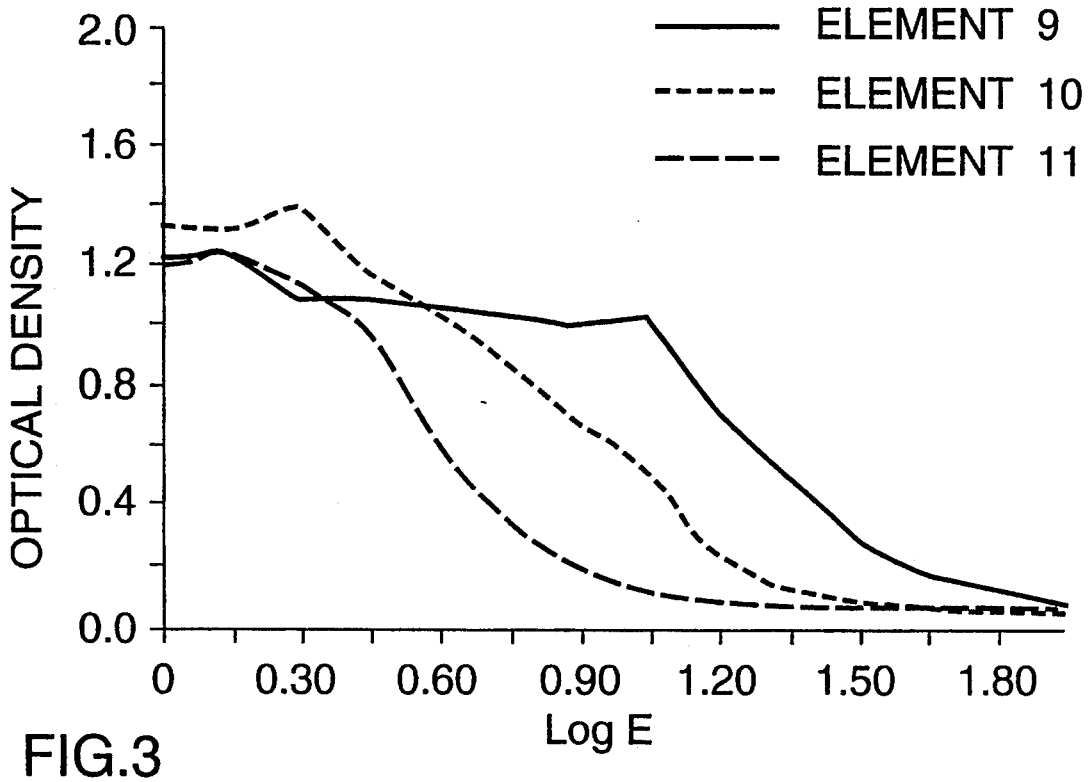
FIG. 3 graphically represents the density versus exposure for three different sensitizers.

Individual samples of Photothermographic Elements 9 to 11 were each exposed to 50 units of UV radiation and thermally processed. The D LogE results are described in Table 7 and FIG. 3.

TABLE 7

| Step Level | | Element 9* (No sensitiser) | Element 10* (DH) | Element 11** (TTP) |
|---|---|---|---|---|
| Dmim | 0 | 0.06 | 0.04 | 0.06 |
| | 1 | 0.11 | 0.05 | 0.05 |
| | 2 | 0.16 | 0.06 | 0.05 |
| | 3 | 0.27 | 0.08 | 0.05 |
| | 4 | 0.50 | 0.12 | 0.06 |
| | 5 | 0.71 | 0.23 | 0.07 |
| | 6 | 1.03 | 0.51 | 0.11 |
| | 7 | 1.00 | 0.68 | 0.19 |
| | 8 | 1.04 | 0.88 | 0.32 |
| | 9 | 1.06 | 1.04 | 0.61 |
| | 10 | 1.09 | 1.18 | 0.99 |
| | 11 | 1.09 | 1.41 | 1.15 |
| | 12 | 1.25 | 1.32 | 1.25 |
| | 13 | 1.23 | 1.34 | 1.25 |

*Thermal Processing Temperature = 127° C./10 seconds
**Thermal Processing Temperature = 130° C./10 seconds The above results show that adding a sensitiser to the photosensitive medium increases the sensitivity of the Element. This was particularly true of Element 11 containing the triarylpyrazoline sensitiser, since this composition was able to give good positive images after an exposure of only 7.5 units of UV radiation (see Table 8 for results.

TABLE 8

| Thermal Processing Temperature (°C.) | Element 11* | |
|---|---|---|
| | Dmin | Dmax |
| 115 | 0.04 | 0.06 |
| 120 | 0.04 | 0.27 |
| 125 | 0.05 | 0.99 |
| 130 | 0.10 | 2.16 |
| 135 | 0.14 | 2.61 |

*UV Exposure = 7.5 units

Example 6

As the photolysis of a sulphonium salt generates both radicals and acid which can oxidise the developer or inhibit the thermographic reaction, two experiments were performed to investigate the effect of changing the toner or developer content on the photosensitive media. In the first experiment, the toner content was doubled and the effect on the sensitivities of the construction measured. The results obtained are tabulated in Table 9 below.

TABLE 9

| Step Level | | D LogE Results (Optical Density) | |
|---|---|---|---|
| | | Element 12* | Element 13** |
| Dmin | (0) | 0.08 | 0.05 |
| | 1 | 0.08 | 0.08 |
| | 2 | 0.07 | 0.12 |
| | 3 | 0.09 | 0.21 |
| | 4 | 0.12 | 0.36 |
| | 5 | 0.16 | 0.74 |
| | 6 | 0.29 | 0.93 |
| | 7 | 0.50 | 1.13 |
| | 8 | 0.72 | 1.43 |
| | 9 | 0.93 | 1.74 |
| | 10 | 1.07 | 1.80 |
| | 11 | 1.18 | 1.89 |
| | 12 | 1.19 | 1.89 |
| | 13 | 1.17 | 1.96 |

Figure 4:
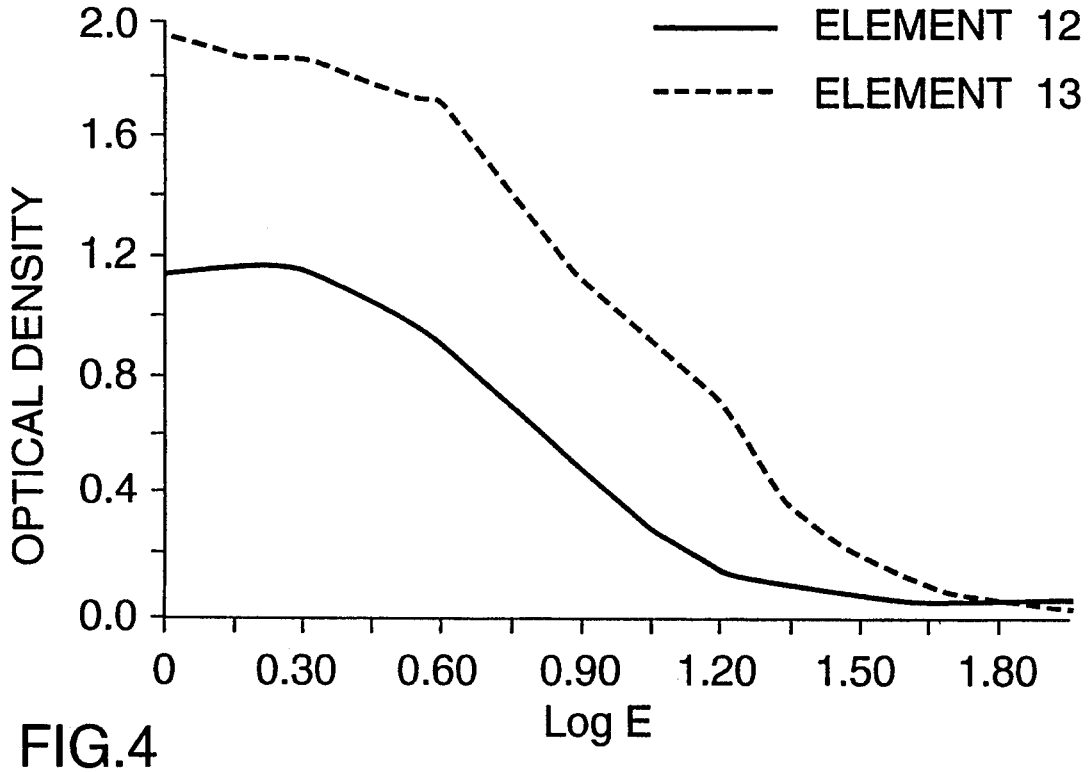
FIG. 4 graphically represents the density versus exposure at different toner levels.

*Thermal Processing Temperature = 135° C./10 seconds
UV = 50 units
**Thermal Processing Temperature = 125° C./10 seconds
UV = 50 units These results show that increasing the toner content decreases the sensitivity of the construction (see FIG. 4). This would suggest that the imagewise production of acid is inhibiting the thermographic development of the silver behenate.

In the second experiment, the developer content was doubled. As the radicals which can oxidize the developer have a short lifetime (i.e., they can be quenched by oxygen), the photo-acid generator was incorporated into both the top and bottomcoats. The results obtained are tabulated in Table 10 below.

TABLE 10

| Step Level | | D LogE Results (Optical Density) Element 14* | Element 15* |
|---|---|---|---|
| Dmin | (0) | 0.06 | 0.07 |
| | 1 | 0.05 | 0.07 |
| | 2 | 0.05 | 0.07 |
| | 3 | 0.05 | 0.07 |
| | 4 | 0.06 | 0.07 |
| | 5 | 0.07 | 0.08 |
| | 6 | 0.11 | 0.09 |
| | 7 | 0.19 | 0.12 |
| | 8 | 0.32 | 0.29 |
| | 9 | 0.61 | 0.55 |
| | 10 | 0.99 | 0.89 |
| | 11 | 1.25 | 1.19 |
| | 12 | 1.15 | 1.35 |
| | 13 | 1.26 | 1.49 |

*Thermal Processing Temperature = 127° C./10 seconds
UV = 50 units

Figure 5:
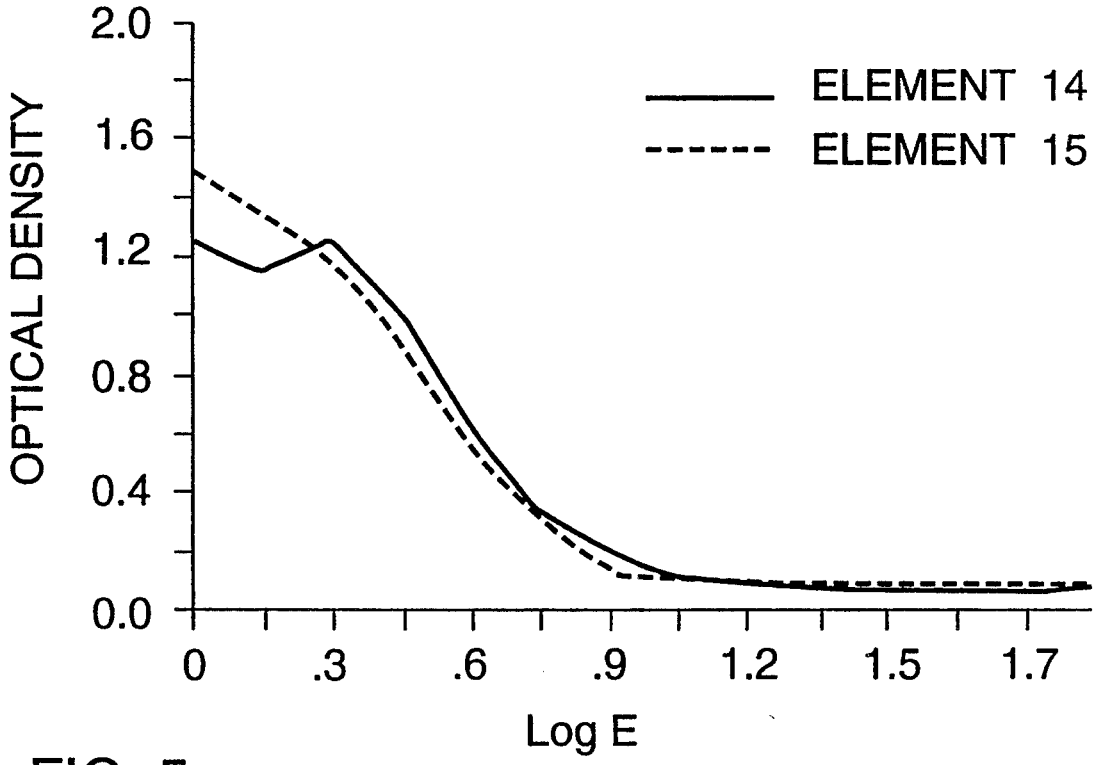
FIG. 5 graphically represents the density versus exposure for different developer levels.

The results show that Elements 14 and 15 (see FIG. 5) have similar sensitivities to Element 12 & 13 and confirm that inhibition of the thermographic development of the silver behenate is caused by the imagewise production of acid.

Example 7

This example shows how the sensitivity of the photothermographic elements of the invention may be improved by the provision of a topcoat (or barrier layer) of cellulose acetate.

Element 16 was prepared from the following formulations:

| | | |
|---|---|---|
| Bottomcoat: | Silver Behenate (Full Soap) = | 20 g |
| | BUTVAR B-76 = | 2 g |
| | tetrachlorophthalic anhydride = | 0.004 g |
| | Developer A = | 0.3 g |
| Middlecoat: | BUTVAR B-76 = | 1.5 g |
| | methyl ethyl ketone = | 5 g |
| | toluene = | 5 g |
| | Sulphonium Salt A = | 0.6 g |
| | DEA = | 0.008 g |
| | Toner A = | 0.015 g |
| Topcoat: | Cellulose Acetate Solution | |

These formulations were coated at 100, 150 and 100 μm wet thickness respectively, each coating being dried for 3 minutes at 80° C. before adding the next.

An analogous 2-layer element (Element 17) was prepared as follows:

| | | |
|---|---|---|
| Bottomcoat: | Silver Behenate (Full Soap) = | 30 g |
| | BUTVAR B-76 = | 3 g |
| | tetrachlorophthalic anhydride = | 0.006 g |
| | Developer A = | 0.45 g |
| Top coat: | Cellulose Acetate Solution = | 30 g |
| | Toner A = | 0.045 g |
| | DEA = | 0.024 g |

-continued

| | | |
|---|---|---|
| | Sulphonium Salt A = | 1.5 g |

Each formulation was coated at a wet thickness of 150 μm and dried for 3 minutes at 80° C.

Samples of each element were UV-exposed to 5 units (Element 16) and 10 units (Element 17) and thermally processed at different temperatures. The optical densities of the exposed (Dmin) and unexposed 5 (Dmax) areas are tabulated in Table 11 below.

TABLE 11

| Thermal Processing Temperature (°C.) | Element 16 Dmin | Element 16 Dmax | Element 17 Dmin | Element 17 Dmax |
|---|---|---|---|---|
| 115 | 0 | 0 | 0 | 0.01 |
| 120 | 0 | 0 | 0 | 0.10 |
| 125 | 0 | 0.07 | 0 | 0.63 |
| 130 | 0 | 0.39 | 0.01 | 0.98 |
| 135 | 0 | 0.80 | 0.05 | 2.59 |
| 140 | 0.01 | 1.56 | 0.11 | 2.72 |
| 145 | 0.01 | 1.67 | — | — |

Element 16 incorporating the optional barrier layer showed very low Dmin (and acceptable Dmax) with only 5 units exposure.

Figure 6:
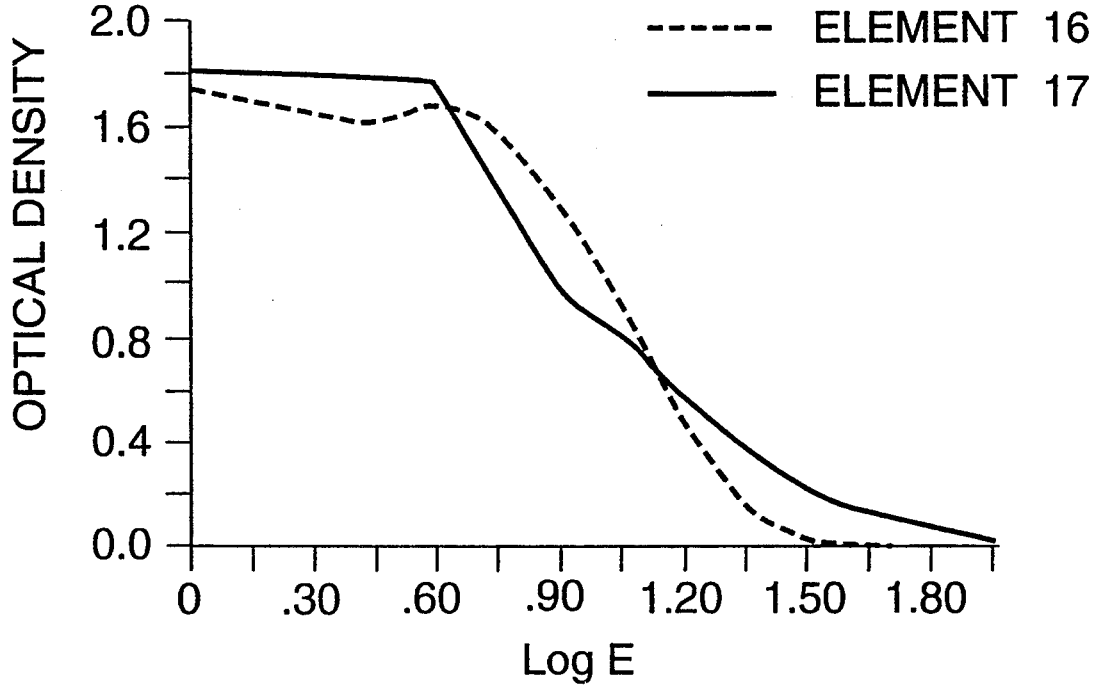
FIG. 6 graphically represents the density versus exposure for two different constructions.

Samples of both elements were given 10 units exposure through a step wedge and processed at 130° C. (Element 17) and 144° (Element 16) for 10 seconds. The DlogE curves were plotted, and are shown in FIG. 6. The greater speed and contrast of Element 16 is readily apparent.

Example 8

This Example demonstrates the use of an iodonium salt as a photo-acid generator in combination with 9, 10-diethoxyanthracene (DEA) as a sensitiser.

Example 17 was prepared from the following formulations:

| | | |
|---|---|---|
| Bottomcoat: | Silver Behenate (Full Soap) = | 20 g |
| | BUTVAR B-76 = | 2 g |
| | Developer A = | 0.15 g |
| | TCPA = | 0.004 g |
| Middlecoat: | BUTVAR B-76 = | 1.5 g |
| | methanol = | 5 g |
| | Toner A = | 0.015 g |
| | methyl ethyl ketone = | 5 g |
| | Iodonium Salt B = | 0.15 g |
| | DEA = | 0.008 g |
| Topcoat: | Cellulose Acetate Solution | |

These formulations were coated at 150 μm wet thickness on a vesiculated polyester support.

Samples of Element 17 were UV-exposed to 25 units and then thermally processed at different temperatures to give the results shown in Table 12 below.

TABLE 12

| Thermal Processing Temperature (°C.) | Element 17 Dmin | Element 17 Dmax |
|---|---|---|
| 125 | 0.02 | 0.03 |
| 130 | 0.04 | 0.08 |
| 135 | 0.04 | 0.11 |
| 140 | 0.03 | 0.24 |
| 145 | 0.05 | 0.31 |

The results show that an image, albeit rather faint, is produced using the combination of iodonium and 9,10-diethoxyanthracene. Processing at higher temperatures may provide clearer images.

Example 9

This Example demonstrates the use of Triazine A as a photo-acid generator.

Element 18 was prepared from the following formulations:

| | | |
|---|---|---|
| Bottomcoat: | Silver Behenate (Full Soap) = | 20 g |
| | BUTVAR B-76 = | 2 g |
| | Developer A = | 0.15 g |
| | TCPA = | 0.004 g |
| Middlecoat: | BUTVAR B-76 = | 1.5 g |
| | toluene = | 5 g |
| | Toner A = | 0.015 g |
| | methyl ethyl ketone = | 5 g |
| | Triazine A = | 0.2 g |
| Topcoat: | Cellulose Acetate Solution | |

These formulations were coated at 150 μm wet thickness on a vesicular polyester support.

Individual samples of Element 18 were UV-exposed to 25 units and then thermally processed at different temperatures to give the results shown in Table 13 below.

TABLE 13

| Thermal Processing Temperature (°C.) | Element 18 Dmin | Dmax |
|---|---|---|
| 120 | 0.00 | 0.13 |
| 125 | 0.03 | 0.58 |
| 130 | 1.30 | 1.30 |

The results show that, by processing the exposed samples at lower temperatures, it is possible to produce a (faint) positive image. However when processing at higher temperatures, the whole element darkens. The images produced by this particular triazine compound are not stable as they will bleach on exposure to UV light owing to the production of chlorine radicals.

I claim:

1. A positive-acting photothermographic element having a photosensitive medium which is free of silver halide comprising a reducible silver source, a photo-acid generator, a binder and a reducing agent for silver ion, in which exposure of the element to actinic radiation causes the production of acidic species in the exposed regions which inhibit reduction of the silver source by the reducing agent.

2. A positive-acting photothermographic element according to claim 1 comprising a support having coated thereon a first layer comprising the reducible silver source and binder and a second layer comprising the reducing agent for silver ion, the photo-acid generator and binder.

3. A positive-acting photothermographic element according to claim 1 comprising a support having coated thereon a first layer comprising the reducible silver source, the photo-acid generator and binder and a second layer comprising the reducing agent for silver ion and binder.

4. A positive-acting photothermographic element according to claim 1 wherein said reducible silver source is a member selected from the group consisting of a silver salt, a silver complex of an organic acid and a silver complex of a hetero-organic acid.

5. A positive-acting photothermographic element according to claim 4 wherein the reducible silver source is silver behenate.

6. A positive-acting photothermographic element according to claim 1 wherein the reducing agent for silver ion is a member selected from the group consisting of phenidone, hydroquinone, catechol and a hindered phenol.

7. A positive-acting photothermographic element according to claim 6 wherein the reducing agent is a hindered phenol having a nucleus of general formula (I):

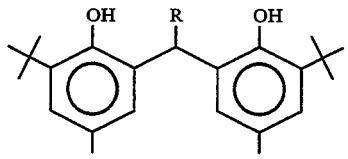

(I)

wherein:

R is a member selected from the group consisting of hydrogen and an alkyl group containing up to 5 carbon atoms.

8. A positive-acting photothermographic element according to claim 1 further comprising as a toner, tetrachlorophthalic acid or its anhydride in combination with a toning agent selecting from the group consisting of a) phthalazinone and b) phthalazine and phthalic acid.

9. A positive-acting photothermographic element according to claim 1 wherein the photo-acid generator is a member selected from the group consisting of sulphonium salts, iodonium salts, phosphonium salts, diazonium salts, quinone diazide sulfochlorides, bis(trichloromethyl)-s-triazines, trichloromethylpyrones and mixtures of organohalogen and organometal compounds.

10. A positive-acting photothermographic element according to claim 9 wherein the photo-acid generator is a member selected from the group consisting of an iodonium salt of general formula (II) and a sulphonium salt of general formula (III):

$$X^{-}I^{+}-(A)_2 \quad \text{(II)}$$

$$X^{-}S^{+}-(A)_3 \quad \text{(III)}$$

wherein:

each A independently represents an aromatic group which may be linked together to include the iodine or sulphur atom within a ring structure, and $X^-$ is an anion such that HX is an acid of $PK_a$ not greater than 3 on photolysis.

11. A positive-acting photothermographic element according to claim 9 wherein the photo-acid generator comprises a cation which is a member selected from the group consisting of:

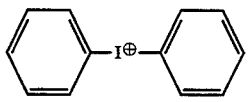

-continued

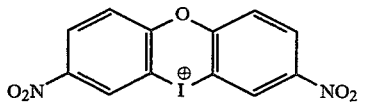

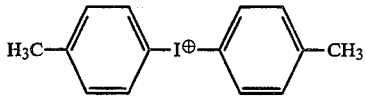

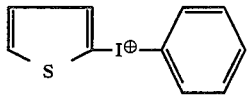

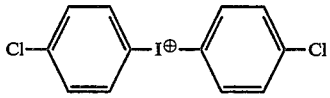

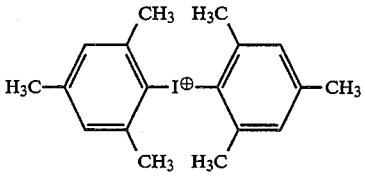

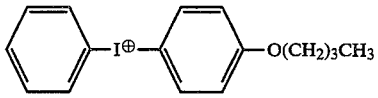

-continued

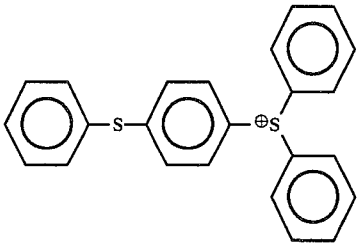

and an anion which is a member selected from the group consisting of $Cl^-$, $Br^-$, $SbF_6^-$, $PF_6^-$, $BF_4^-$, $AsF_6^-$, $HSo_4^-$, $CF_3SO_3^-$, $CF_3CO_2^-$, $CCl_3CO_2^-$, $CH_3SO_3^-$ and $CH_3C_6H_4SO_3^-$.

12. A positive-acting photothermographic element according to claim 1 wherein the element further comprises a sensitiser selected from xanthene dyes, 3-substituted coumarins, dialkoxyanthracenes, 1,4-dihydrophyridines, 1,3,5-triarylpyrazolines and oxonol dyes.

13. The element of claim 1 wherein a toner is present in the element, the toner comprising tetrachlorophthalic acid or its anhydride.

14. A positive-acting photothermographic element according to claim 1 further comprising a toner selected from the group consisting of a) phthalazinone, and b) phthalazine and phthalic acid.

15. A positive-acting photothermographic element having a photosensitive medium comprising a reducible silver source, a photo-acid generator, a binder, and a reducing agent for silver ion in which exposure of the element to actinic radiation causes the production of acidic species in the exposed regions which inhibit reduction of the silver source by the reducing agent, which contains less than 0.75% by weight of silver halide based on the weight of the reducible silver source.

* * * * *

UNITED STATES PATENT AND TRADEMARK OFFICE

CERTIFICATE OF CORRECTION

PATENT NO. : 5,387,498

DATED : February 7, 1995

INVENTOR(S) : Ellis et al.

It is certified that error appears in the above-indentified patent and that said Letters Patent is hereby corrected as shown below:

Column 13, line 37, delete

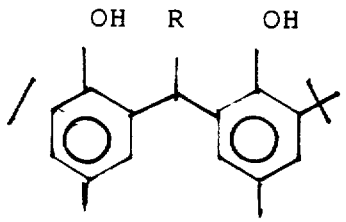

and insert

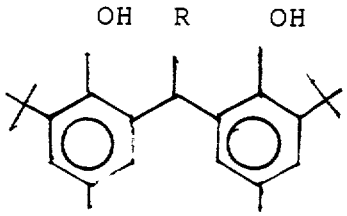

UNITED STATES PATENT AND TRADEMARK OFFICE

CERTIFICATE OF CORRECTION

PATENT NO. : 5,387,498

DATED : February 7, 1995

INVENTOR(S) : Ellis et al.

It is certified that error appears in the above-indentified patent and that said Letters Patent is hereby corrected as shown below:

Column 16, line 53, delete "and 8"
and insert --7 and 8--.

Column 22, line 56, delete "$PK_a$"
and insert --$pK_a$--.

Signed and Sealed this

Tenth Day of October, 1995

*Attest:*

*Attesting Officer*

Bruce Lehman

BRUCE LEHMAN

*Commissioner of Patents and Trademarks*